US006861960B2

(12) United States Patent
Hessing et al.

(10) Patent No.: US 6,861,960 B2
(45) Date of Patent: Mar. 1, 2005

(54) METHOD FOR TRANSMITTING TRAFFIC INFORMATION ABOUT A TRAFFIC OBSTRUCTION

(75) Inventors: Bernd Hessing, Holle (DE); Heinrich Schmidt, Diekholzen (DE)

(73) Assignee: Robert Bosch GmbH, Stuttgart (DE)

( * ) Notice: Subject to any disclaimer, the term of this patent is extended or adjusted under 35 U.S.C. 154(b) by 199 days.

(21) Appl. No.: 09/821,332

(22) Filed: Mar. 29, 2001

(65) Prior Publication Data

US 2001/0028314 A1 Oct. 11, 2001

(30) Foreign Application Priority Data

Mar. 30, 2000 (DE) ..... 100 15 935

(51) Int. Cl.[7] ..... G08G 1/123

(52) U.S. Cl. ..... 340/995.1; 340/995.13; 701/117

(58) Field of Search ..... 340/995.1, 905, 340/995.13, 995.12; 701/200, 117, 118, 209, 210

(56) References Cited

U.S. PATENT DOCUMENTS 5,293,163 A * 3/1994 Kakihara et al. ..... 340/995
5,862,244 A * 1/1999 Kleiner et al. ..... 382/104
5,892,463 A * 4/1999 Hikita et al. ..... 340/995
5,999,877 A * 12/1999 Takahashi et al. ..... 701/117
6,006,161 A * 12/1999 Katou ..... 701/212
6,314,360 B1 11/2001 Becker
6,480,783 B1 * 11/2002 Myr ..... 701/117

FOREIGN PATENT DOCUMENTS

WO 99/48073 9/1999

* cited by examiner

*Primary Examiner*—John Tweel
(74) *Attorney, Agent, or Firm*—Michael J. Striker

(57) ABSTRACT

The method of transmitting traffic information about a traffic obstruction on a traffic way with digital coded messages includes coding a coded location contained in a location data bank, which amounts to an approximate position of the traffic obstruction on the traffic way, and a section part of the traffic way between the coded location and an actual position of the traffic obstruction on the traffic way in a traffic message and then transmitting the traffic message. In addition the length of the traffic obstruction can be included in the traffic message. In a preferred embodiment the traffic message is a TMC traffic message coded with ALERT-C protocol. In which the section part is coded in label 12 and the length in label 2.

7 Claims, 1 Drawing Sheet

METHOD FOR TRANSMITTING TRAFFIC INFORMATION ABOUT A TRAFFIC OBSTRUCTION

BACKGROUND OF THE INVENTION

The present invention relates to a method for transmitting traffic information, in particular a position of a traffic obstruction on a traffic, in digital coded messages.

For coding and decoding of the messages, location data banks are utilized at transmitters and receivers, and a rough position of the traffic information is coded by referencing to a traffic way and at least one location which is contained in the location data banks and located on the traffic way.

The transmission of digitally coded traffic massages, in particular of TMC (Traffic Message Channel) messages which are coded in accordance with the ALERT-C-protocol and decoded, is supported on the location, which is performed both at the side of the transmitter and also the side of the receiver in connection with traffic ways in location date banks. These locations are traffic-relevant points, such as for example departures and intersections, which are referenced with one another in form of a precursor and successor and to associated street segments, wherein the associated street segment is a part of the street.

By limiting to these traffic-relevant points, the range of the location list is minimized. Simultaneously however a complete description of the traffic way network, in particular a street network is not possible. The description of the roadways is relatively complete. However, for the subordinate street classes, one or several not coded knot points are located between two coded locations. Since in TMC messages only one location code is transmitted per message (primary location), to which the obstruction relates, and a measure which indicates how many coded locations are on one section pertains to the obstruction, both the beginning and the end of the obstruction is transmitted only in form of coded locations (primary and secondary locations). Since the number of the coded locations at the subordinate street classes is low, the precision of the location indication is here not satisfactory, since between the primary and the secondary location as a rule several intersections with other streets are located, which can be used by a navigation system for detouring of the obstruction.

SUMMARY OF THE INVENTION

Accordingly, it is an object of the present invention to provide an exact transmission of a position, in particular the position of a traffic obstruction on a traffic way.

In keeping with these objects and with others which will become apparent hereinafter, one feature of present invention resides, briefly stated, in a method, in which additionally to the location, the section part between the position and the location is transmitted. Thereby additionally at the receiver's side it is possible, by the comparison of the transmitting position with not coded intersections, to use streets for detouring of the obstruction, which with the known transmission in accordance with the ALERT-C by means of location code of the primary location and by means of dimension of the obstruction, was not possible.

The inventive method is not only usable with RDSITMC (Radio Data System/Traffic Message Channel), but also in general is usable where on the basis of coded location data banks, messages can be transmitted, for example with GSMITMC (Global System for Mobile Communication/Traffic Message Channel).

In accordance with one embodiment of the invention it is possible that the section part is referred to the section between the coded location and a location which is spaced on the traffic way from the coded location by the measure. Since the transmission capacity for the section part is limited, therefore in this embodiment a possible not satisfactory accuracy is provided when the measure includes many street segments.

For eliminating this disadvantage, in accordance with another embodiment of the inventive method, it is provided that the section part refers to the section between the coded location and a location which is exactly adjoining the coded location and is available in the data bank on the same traffic way.

For additional numbers which also represent the section part, there are various possibilities in a TMC message in accordance with ALERT-C. In particular, with respect to the compatibility with the existing transmitters and receivers, an embodiment of the invention is especially suitable when during a coding in accordance with the ALERT-C protocol, the coding of the section part is performed in a Label 15. A similarly favorable possibility is provided, when during the coding in according with the ALERT-C protocol, the coding of the section part is performed in Label 12.

The Label 5 is available with a 5-bit data field. Thereby with the position an accuracy of 5% can be reached, which is sufficient for fulfilling the inventive objectives. With the use of the label 12 a 16-bit value for the section part can be provided, which produces a corresponding high accuracy.

The traffic information whose position is transmitted with the inventive method can be referred to a point-like location, for example a street obstruction, a danger point, or a status information, such as the average speed of the vehicles which pass the point-like location. A traffic information can be related however also to an expanded event or object, such as for example a traffic obstruction jam).

For the transmission of the end of a traffic obstruction, it is provided in the inventive method that by means of the section part, the position of the beginning (cause) of a traffic obstruction is transmitted, and the end of a traffic obstruction can be calculated from the length transmitted via the Label 2 or from the transmitted event code. Both possibilities are provided at a suitable receiver, since at the side of the transmitter it is not determined whether for transmission of the length of a traffic obstruction either a label, 2 or an event code is utilized.

TMC receivers can basically operate also with data banks without distance data. For this case another embodiment of the present invention provides the possibility of coding of the positions transmitted by the inventive method so that, when distance data are not available in the location data bank of the receiver, the distance data can be taken from a digital map associated with the receiver.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
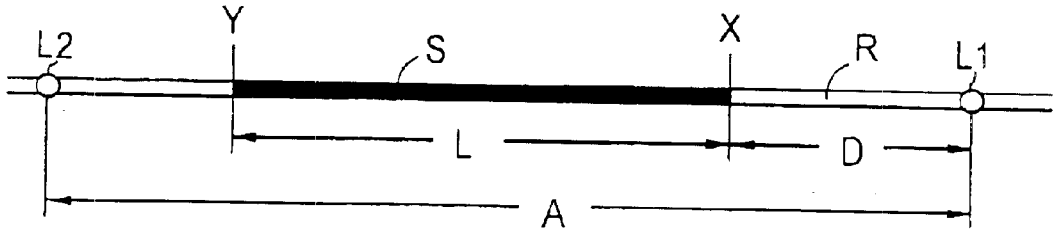
FIG. 1 is a view schematically showing a position of an obstruction and different length measures in the case of a first embodiment of the invention.

In accordance with the present invention as mentioned herein above, in a TMC message in accordance with ALERT-C, an obstruction S is coded by indication of a primary location L1 and a measure in form of the number of street segments to a secondary location L2, between which the obstruction S is located. In the drawings it is highlighted by the filling of the double line represented the street R. This is performed also, when as in the shown embodiments, the obstruction S does not extend between the points X (beginning point) and Y (end point) over the total distance between L1 and L2. Additionally, in accordance with the ALERT-C the obstruction length L can be coded by the Label 2 with an accuracy of substantially 10%.

In the embodiment shown in FIG. 1, the position of the point X, the beginning of the obstruction, is obtained by transmitting a percentage P, which is equal to the section portion D divided by the distance between the coded location L1 and the coded location L2 times 100. Since A is either stored in the location data bank of the receiver or can be taken from a digital map, D can be calculated from the transmitted value 4.

At the transmitter side, the variable to be transmitted is calculated from the known values D and A as $P=D/Al\times100$. When for example, the distance between L1 and L2 amounts to 20 km and the obstruction cause is located 6 km from the primary location L1, the parameter P to be transmitted amounts to 30%.

Figure 2:
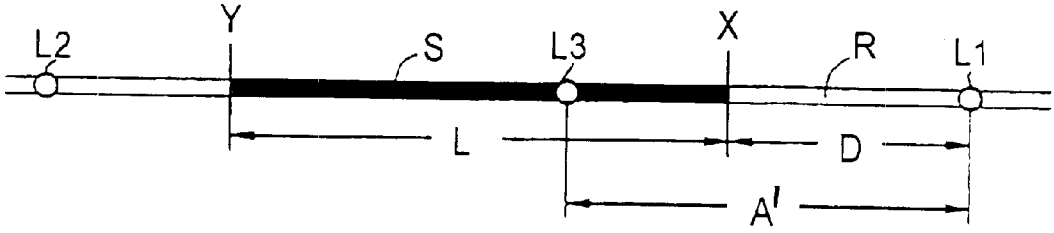
FIG. 2 is a view showing a corresponding variables in accordance with a second embodiment of the present invention.

In the embodiment of FIG. 2, a further location L3 is provided between both locations L1 and 12. It is also carried out from the location data bank. For the same obstruction S between the points X and Y, then a TMC message is transmitted. This means that before the location L1 an obstruction with the dimension 02 is provided, which can mean without additional data that the total section between L1 and L2 is related to the obstruction.

With the coding in accordance with FIG. 2, in contrast to FIG. 1 the section part D is not related to the distance between L1 and L2 but instead to the distance A', so that the position X is transmitted with greater accuracy. A parameter to be transmitted is calculated as $P'=D.100/A'$.

P or P' is then transmitted as a data telegram with the characteristic label 15 to the receiver. If the same coding table is used as with the qualifier 3, then as five-bit value a 6 is provided, which is transmitted in the data field following the Label 15. The decoding in the receiver is performed for example via a look-up table.

Figure 3:
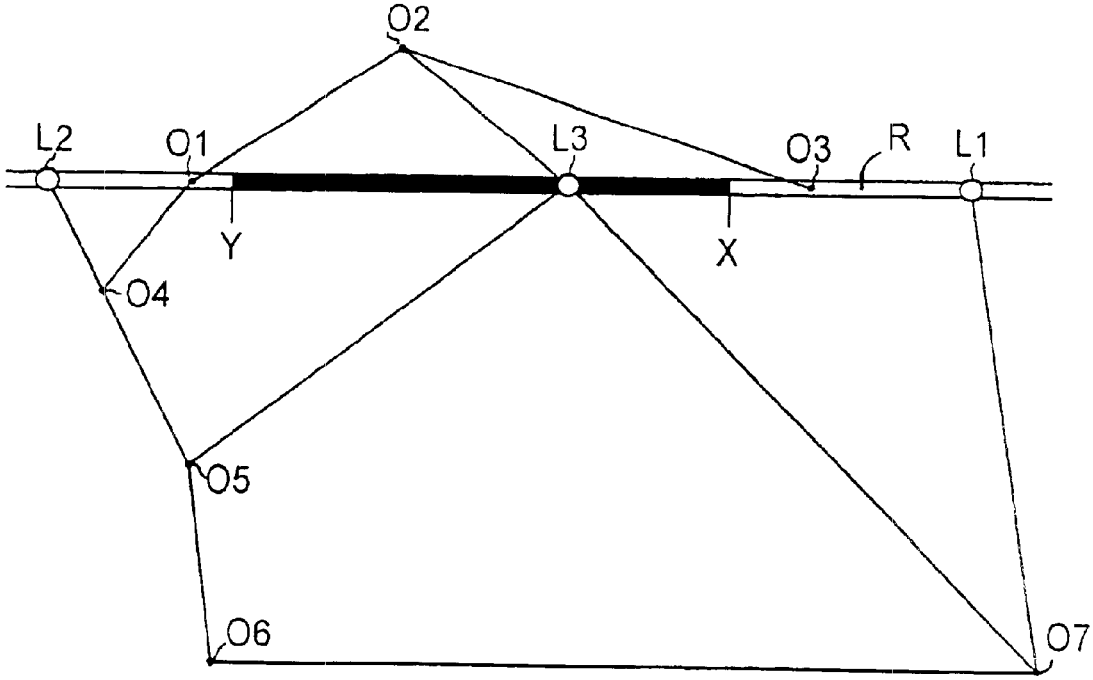
FIG. 3 is a view schematically showing a reduction of a detour required because of an obstruction.

Based on this information the receiver can calculate, on the one hand, the position of the point X and, on the other hand, with the use of the also transmitted obstruction length L the position of the point Y. As shown in FIG. 3, in connection with a navigation system which is available via a digital map, these informations can be utilized for advising the driver closely at the jam end, and after detouring the jam, for returning earlier to the initial section.

FIG. 3 shows the same section as FIG. 2 with the locations L1, 12 and L3, as well as the obstruction S between the points X and Y. Moreover, further locations 01–07 are shown. From which least the locations 01 and 03 are not entered or coded in the location data banks utilized for coding and decoding. With the inventive transmission of position of the jam beginning X and the jam end Y the driver can be guided via the locations 01, 02, and 03, or in other words via shorter detour sections than via the coded locations 04, 05, 06 and 07 without the use of the inventive method.

Alternatively to the use of the Label 15, the Label 12 can be utilized. For this purpose in ALERT-C a 16-bit field is provided for the value. Thereby the position with a higher resolution (substantially in 100%165536) when needed can be transmitted. Analogously the inventive method is also possible with different indicators than the percentage indicators of the section part, for example as an absolute or a relative distance, for example in length units or with Label 2 or with Label 5, quantifier 9, or by introducing a new table (corresponding use with quantifier see CENV 12313-2).

It will be understood that each of the elements described above, or two or more together, may also find a useful application in other types of methods differing from the types described above.

While the invention has been illustrated and described as embodied in method for transmitting a position of a traffic information, in particular a traffic obstruction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method of transmitting traffic information about a traffic obstruction on a traffic way with digital coded messages, said method comprising the steps of:

a) coding a coded location designating a traffic-relevant point on the traffic way in a traffic message;

b) coding a section part of the traffic way extending from said coded location to an actual position of the traffic obstruction on the traffic way in the traffic message;

c) describing said section part in relation to a measure, and wherein said measure is a distance between said coded location on said traffic way and another coded location on said traffic way spaced from said coded location and said section part is described as a percentage of said measure; and d) transmitting the traffic message.

2. The method as defined in claim 1, wherein said traffic-relevant point is an intersection of the traffic way or an exit from the traffic way.

3. The method as defined in claim 1, wherein said traffic message is a TMC traffic message coded with ALERT-C protocol, and further comprising coding said section part in label 15 of said TMC traffic message.

4. The method as defined in claim 1, wherein said traffic obstruction has a length and said position of said traffic obstruction corresponds to a beginning of said traffic obstruction, and further comprising coding said length of said traffic obstruction in said traffic message.

5. The method as defined in claim 4, wherein said traffic message is a TMC traffic message coded with ALERT-C protocol and said length of said traffic obstruction as coded in label 2 of said TMC traffic message.

6. The method as defined in claim 5, further comprising calculating an end position of the traffic obstruction on the traffic way from said length transmitted in said label 2.

7. The method as defined in claim 1, wherein said traffic obstruction has a length and said position of said traffic obstruction corresponds to a beginning of said traffic obstruction and further comprising calculating an end of the traffic obstruction from a transmitted event code in said traffic message.

* * * * *